US005298746A

United States Patent [19]

Franzen et al.

[11] Patent Number: 5,298,746

[45] Date of Patent: Mar. 29, 1994

[54] METHOD AND DEVICE FOR CONTROL OF THE EXCITATION VOLTAGE FOR ION EJECTION FROM ION TRAP MASS SPECTROMETERS

[75] Inventors: Jochen Franzen; Reemt-Holger Gabling, both of Bremen, Fed. Rep. of Germany

[73] Assignee: Bruker-Franzen Analytik GmbH, Bremen, Fed. Rep. of Germany

[21] Appl. No.: 997,284

[22] Filed: Dec. 23, 1992

[30] Foreign Application Priority Data

Dec. 23, 1991 [DE] Fed. Rep. of Germany ..... 4142869

[51] Int. Cl.[5] ..... H01J 49/42

[52] U.S. Cl. ..... 250/292; 250/282

[58] Field of Search ..... 250/292, 291, 290, 282

[56] References Cited

U.S. PATENT DOCUMENTS 5,173,604 12/1992 Kelley ..... 250/292

5,182,451 1/1993 Schwartz et al. ..... 250/292

*Primary Examiner*—Jack I. Berman

*Attorney, Agent, or Firm*—Cesari and McKenna

[57] ABSTRACT

An improved scanning method used in an ion trap mass spectrometer comprises controlling the amplitude of the excitation RF during the mass scan to produce a smooth, nonlinear, highly suitable function. A smooth function is a function with a steady derivative. According to one embodiment of the invention, the excitation amplitude is set proportionally to the square root of the storage amplitude, thus making the excitation amplitude proportional to the root of the mass number.

8 Claims, 2 Drawing Sheets

METHOD AND DEVICE FOR CONTROL OF THE EXCITATION VOLTAGE FOR ION EJECTION FROM ION TRAP MASS SPECTROMETERS

FIELD OF THE INVENTION

The invention concerns methods and devices for recording mass spectra by using an RF quadrupole ion trap in which ions are retained in the trap by a storage RF voltage applied between the trap end caps and ejected mass-sequentially through holes in one of the ion trap end caps under the influence of an excitation RF voltage. The invention particularly concerns the establishment of an optimum mass dependency for the excitation RF voltage.

BACKGROUND OF THE INVENTION

Quadrupole ion traps according to Paul and Steinwedel (German patent DE-PS 944 900) consist of ring and end cap electrodes between which an essentially quadrupolar storage field is generated by applying RF voltages to the ring and end caps. Ions with varying mass-to-charge ratios (m/q) can be stored at the same time in this field (for the sake of simplicity, only "masses" instead of "mass-to-charge ratios" are referred to in the following since, in ion traps, one is predominantly only concerned with singly charged ions).

Physically intrinsic resonance conditions of the storage field are preferably used for ion ejection. With a pure quadrupole field, resonance conditions of this kind are found at the edge of the stability zone in the a,q diagram. In addition, with certain nonlinear conditions, in particular, those which occur in the case of a superposition of multipole fields, resonance conditions occur inside the stability zone and can also be used for ion ejection.

FIG. 1 shows some known storage field resonance conditions for a pure quadrupole field and for superposed hexapole and octopole fields plotted on an a,q stability diagram. The storage field resonances, $\beta_z=1$ (for pure quadrupole), $\beta_z=\frac{2}{3}$ (for hexapole superposition), $\beta_z+\beta_r=1$ and $\beta_z=\frac{1}{2}$ (both for octopole superposition), have been plotted. The following applies in the customary manner:

$$a=-8zU/(mr_0^2\Omega^2),\ q=4zV/(mr_0^2\Omega^2)$$

where:

- z=Coordinate of the rotationally symmetric axis of the ion trap,
- U=Direct voltage with which the RF storage field is superposed,
- m=Mass of ions,
- $r_0$=Inside radius of the ring electrode,
- $\Omega$=Angular frequency of the storage RF, and
- V=Amplitude (voltage) of the storage RF The advantages of these superposed multipole fields are discussed in detail in the *International Journal of Mass Spectroscopy Ion Processes*, J. Franzen, v. 106, pp. 63–78 (1991) which article is hereby incorporated by reference.

For measurement of the spectra, the ions are brought to a resonance condition of this kind mass by mass by changing the amplitude of the quadrupole RF storage field. When ions of a particular mass reach the resonance condition, they absorb energy from the RF storage field, enlarge their oscillation amplitudes and leave the ion trap through small holes in one of the end caps. The ejected ions can then be measured outside the ion trap with an ion detector.

The secular oscillation frequency of the ions varies widely after their production or introduction into the trap. Consequently, in order to provide a well-resolved mass spectrum, it is necessary to first collect the oscillating ions confined in the ion trap near the center of the ion trap to enable the ions of successive masses to leave the ion trap in ejection cycles clearly separated from each other in terms of time. For this, the ion trap is preferably filled with a special damping gas having an optimal density enabling the ions to release energy by colliding with the remaining gas in the trap. When such a gas is introduced, the trapped ions "thermalize" after a few collisions and collect at the center of the quadrupole field due to the focusing effect of the quadrupole field, reducing their oscillation amplitudes at the same time. They form a small cloud, the diameter of which is only approximately 1/20 to 1/10 of the dimensions of the trap according to tests carried out with laser beams as described in *Physical Review A*, I. Siemers, R. Blatt, T. Sauter and W. Neuhauser, v. 38, p. 5121 (1988) and *Journal of the Optical Society of America B*, M. Schubert, I. Siemers and R. Blatt, v. 6, p. 2159 (1989). Thermalization takes place particularly quickly with medium-weight damping gas molecules such as air.

The absorption of energy under the resonance condition physically built into the storage field necessarily assumes, however, that the ions are not in a state of calm at the center of the quadrupole field since the field intensity as well as the condition of resonance disappear there. Absorption of energy due to the physically intrinsic resonance is only possible further away from the field center and increases as the ions move further from the center due to oscillations.

It is therefore beneficial to intentionally weakly excite the secular oscillation of the ions shortly before they are brought to the resonance condition. This excitation is produced by bringing the ions into resonance with a relatively weak RF excitation voltage connected via the two end caps to produce an effective field at the center of the ion trap. Only this initial coherent excitation of the ions of a particular mass enables them to absorb energy from the RF storage field in the further course of the scanning process when they reach the resonance condition. This energy absorption causes the ions to be exponentially accelerated and thus ejected from the ion trap.

Methods are already known of removing ions from the ion trap in resonance solely by the effect of the applied excitation RF voltage, for example as described in G. Rettinghaus, Z. f. Angew. Physik 22, 321, 1967. However, when the excitation voltage alone is used for ion ejection, the absorption of energy essentially leads to a linear rise in secular ion oscillation amplitude. This compares to an exponential increase, at least at the beginning, which results from use of built-in field resonance. Consequently, ion ejection is much sharper when the intrinsic field resonances are used and can be carried out in fewer oscillation cycles.

A simple scanning method with mass-sequential ejection of ions utilizing the limit of the stable storage range ($\beta_z=1$) in the a,q diagram, without application of an additional excitation frequency for exciting the secular oscillation, has already been known for some time and is described in U.S. Pat. No. 4,540,884. However, a considerable improvement in the resolution of this latter method was obtained by the introduction of "axial modulation", which is a coherent excitation of the secular ion oscillation shortly before reaching the stability limit as described in EP-A1 0 350 159. The use of a nonlinear resonance $\beta_z+\beta_r=1$, produced by superposing a weak octopole field onto the quadrupole field, is similarly well-known with ejection of ions after initial pushing of the secular oscillation as described in European patent applications EP-A1 0 336 9901 and EP-A1 0 383 961.

With respect to ion ejection, the nonlinear multipole resonance conditions and the resonance on the stability margin differ only in so far as the multipole resonances each show sharply defined singularities (mathematical poles), while the stability margin, $\beta_z=1$, of the quadrupole field sharply separates two large areas, one stable and the other unstable. In both cases, however, the ions experience conditions under which they are able to absorb oscillation energy from the storage field.

If even multipoles are involved (octopoles, dodecapoles etc.), the singularities in the stability zone by no means represent points of instability, but only points for limited absorption of energy, since the secular frequency of the resonating ions changes with increasing amplitude and thus no enduring resonance condition exists which is unlimited in terms of time.

Under optimal conditions, the coherent initial pushing of the secular oscillation for a particular ion type should be arranged to take place a very short time (approximately 10 to 100 microseconds) before the storage field resonance is reached so that the coherently oscillating ions of the ion cloud are not again disturbed by collisions with the remaining gas. In order to achieve this, it is necessary for the excitation voltage to have a frequency slightly lower than the storage field resonance.

The amplitude setting for this excitation RF voltage is critical. The mass-spectrometric resolution decreases both with regard to voltage amplitudes which are higher or lower than the optimum voltage amplitude. The optimum is usually set by observing the output with an oscillograph, though it is also possible to use a representation of the scan profiles by means of a computer system.

Alteration of the excitation RF amplitude causes not only a change in resolution, but also a change in the scanning function, i.e. the function $m=f(A)$, m being the mass of the ions and A the amplitude of the storage RF, used for scanning. With increased excitation amplitude, the masses appear at the exit holes earlier since they have already received excitation energy from the end cap electrodes by the excitation RF and only have to absorb a small amount of energy from the storage field to produce ejection. Consequently, for optimal results, it must be possible to reproduce the excitation amplitude well. With fast mass scans, slight changes in the ion ejection time can amount to several units of mass on the mass scale.

Experiments have established that neither a constant amplitude of the excitation voltage nor a linear change in the amplitude during the scanning process produces an optimal resolution for all masses. Although it is possible to keep resolution at an optimum by means of a piece-wise linear control, this results in nonlinearities of the scanning function at the breakpoints between the linear parts.

There are some methods (such as ion isolation or the very fast subsequent data processing) which require as constant a mass control as possible with the amplitude of the storage RF. Methods for isolation of ions and for fragmentation need a linear and constant control of the masses with an accuracy better than 1/10 of a unit of mass.

Consequently, it is the task of the invention to create a method of scanning which combines as smooth (i.e. not only partially linear) a scanning function as possible with as good a mass resolution as possible for all masses. Here, the scanning function is defined as the dependence of the mass of the ions ejected on the voltage amplitude of the storage RF.

SUMMARY OF THE INVENTION

The improvement of the scanning method according to the invention comprises controlling the amplitude of the excitation RF during the mass scan to produce a smooth, nonlinear, highly suitable function. A smooth function is a function with a steady derivative.

According to one embodiment of the invention, the excitation amplitude is set proportionally to the square root of the storage amplitude, thus making the excitation amplitude proportional to the root of the mass number.

Surprisingly, such a control of the excitation voltage not only provides optimal conditions for resolution for all masses of the mass scale, but also produces optimal linearity of the scanning function at the same time. Even for the expert, this solution is not immediately apparent. The expert would rather expect optimal conditions when the oscillation amplitude generated by the excitation voltage is the same for all masses.

According to another embodiment of the invention, a digital control is used to generate the excitation voltage. However, a digital control cannot, by nature, produce completely "smooth" outputs, since its operation is necessarily clocked and it works with control values which change in discrete steps. It is therefore necessary to establish in more detail what is to be understood by "smooth".

For a mass spectrum, there is a natural limit for unevenness. The digital control must ensure that changes in the excitation RF amplitude are set no later than the time at which scanning is commenced for the next respective mass. Another embodiment of the invention therefore produces at least one new amplitude value per mass during the scan. Output of several amplitude values per mass is, of course, also possible. A preferred embodiment therefore outputs precisely n control values per unit of mass, n being a whole number.

DETAILED DESCRIPTION OF THE PREFERRED EMBODIMENT

Figure 1:
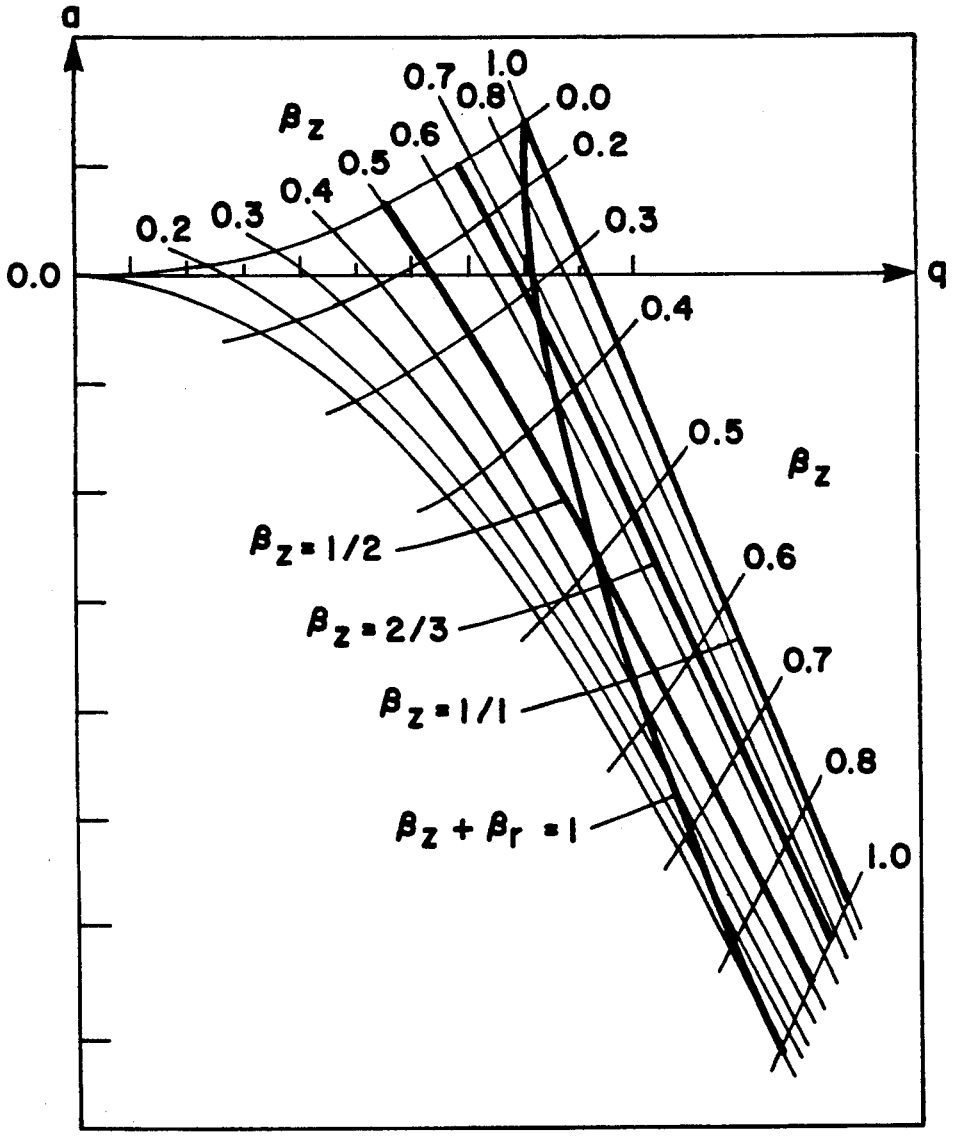
FIG. 1 is a diagram of the a,q stability diagram with isobeta lines describing the secular frequencies in the r and z directions. The three storage field resonances, $\beta_z=1$ (for quadrupole), $\beta_z=\frac{2}{3}$ (for hexapole superposition) and $\beta_z=\frac{1}{2}$ (for octopole superposition) have been plotted.
Figure 2:
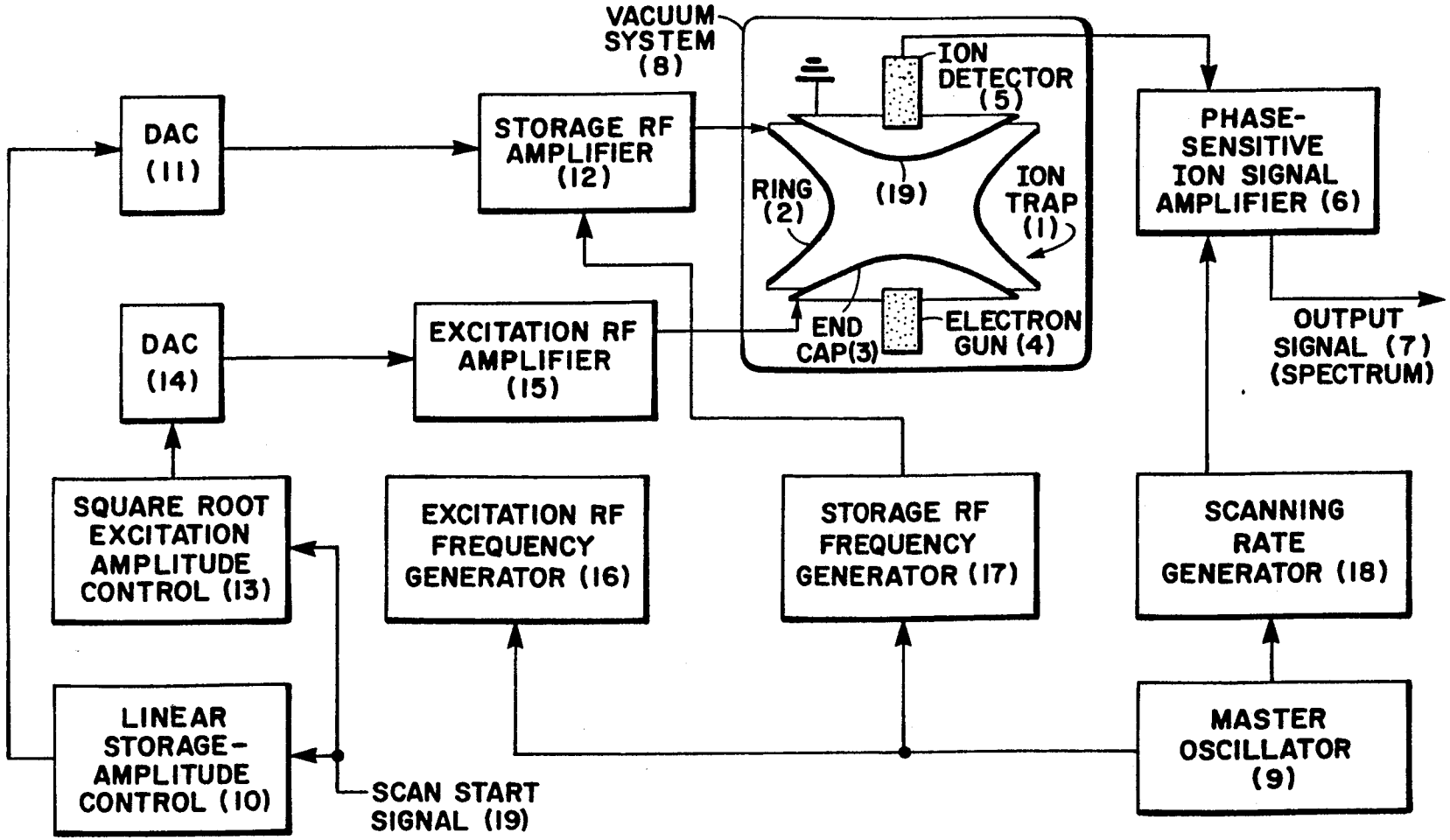
FIG. 2 is a block diagram of the ion trap with the necessary RF voltages and measurement of the ion streams for producing the mass spectrum. Digital control of the amplitudes for the storage RF and excitation RF is shown in particular.

A preferred device for carrying out the method is shown in FIG. 2 as a block diagram. The ion trap consists of a ring electrode (2) and end cap electrodes (3). A mixture of weak hexapole and octopole fields is superposed on the quadrupole field of the ion trap (1) by the shape (not shown in detail in FIG. 1) of the electrodes as described in German patent DE-OS 40 17 264.3. The ion trap is located in a vacuum system (8) and can be filled through an inlet (not shown) with traces of substances, the mass spectra of which are to be recorded, and with a collision gas for damping the ion oscillations.

An electron gun (4) produces an electron beam which can be controlled by pulses. The beam generates ions of the substances during an ionization cycle which ions thermalize in a subsequent damping interval due to collisions with the collision gas. Scanning is started by a scan start signal appearing on lead (19). At the start of the scan, a mass scan profile is produced by a digital storage amplitude control (10) which supplies an essentially linearly rising sequence of control values. The digital output values are applied to a digital to analog converter (11) which, in turn, generates an analog signal that controls the amplitude of the storage RF amplifier (12). The frequency of the storage RF amplifier is obtained from the storage RF frequency generator (17). In FIG. 1, the storage RF is only connected to the ring electrode (2) of the ion trap (1).

The ion trap has a first grounded end cap electrode (19), and a second end cap electrode (3), to which the weak excitation RF voltage is fed. Experimental findings show that no harm is caused whatsoever by the slight asymmetry of the electrode voltages.

The values for the excitation RF voltage amplitude are produced by an excitation amplitude control (13), which is also triggered by the scan start signal on lead (19). According to the invention, these values are proportional to the square root of the storage amplitude. The digital values generated by the excitation amplitude control (13) control the excitation RF amplifier (15), via an analog signal generated by a digital-to-analog converter (DAC) (14). The frequency of the excitation amplifier is controlled by the excitation RF frequency generator (16). The frequencies for the excitation RF frequency generator (16), the storage RF frequency generator (17) and scanning rate generator (18) for the phase sensitive amplifier (6) are derived from a master oscillator (9).

During a scan operation, the ions in the ion trap (1) are brought to a resonance with the excitation RF mass by mass, resulting in linear enlargement of the secular oscillation, then to a resonance with the storage field resulting in an exponential rise in secular amplitude. Methods for exciting the ions in-phase for optimum ion ejection are discussed in detail in a copending patent application entitled "Method and Device for In-phase Excitation of Ion Ejection From Ion Trap Mass Spectrometers" filed at the same time as the present application by Jochen Franzen and assigned to same assignee, which application is hereby incorporated by reference.

The ejected ions are measured via an ion detector (5) which is preferably a secondary-emission multiplier. The analog signal from the secondary-emission multiplier, amplified with practically no time delay, is supplied to the ion signal amplifier (6) and also digitized there. Methods for operating the ion signal amplifier (6) for in-phase measurement of ions to produce optimal low-noise spectra are described in detail in a copending patent application entitled "Method and Device for In-phase Measuring of Ions From Ion Trap Mass Spectrometers" filed at the same time as this application by Jochen Franzen, Gerhard Heinen, Gerhard Weiss and Reemt-Holger Gabling and assigned to the same assignee, which application is hereby incorporated by reference.

The consecutive digital values of the output signal (7) form the raw spectrum which can be processed further with known means in a data system to generate the mass spectrum. In particular, fast methods for data compression of the digital spectrum from measurement data are known. A general introduction to the state of technology is provided by the book, "*Quadrupole Storage Mass Spectrometry*", by R. E. March and R. Hughes, Wiley, New York, 1989).

What is claimed is:

1. Method for recording the mass spectra of ions stored in a pure or multipole-superposed RF quadrupole ion trap according to the principle of ejection of ions through holes in one of the end caps with the aid of absorption of energy by means of a resonance condition of the storage field which is made successively effective for the ions of various masses by alteration of the storage field amplitude, with excitation of the axial secular oscillation of the ion type to be ejected by an excitation frequency applied to the two end caps, becoming effective by excitation resonance shortly before or while the ions experience the storage field resonance, and measurement of the ions ejected outside the ion trap, characterized in that the voltage amplitude of the excitation field is controlled approximately proportionally to the root of the storage field amplitude during linear alteration of the voltage amplitude of the storage field for the mass scan.

2. The method as in claim 1, characterized in that the proportional control factor between the excitation field amplitude and root of the storage field amplitude is adjustable.

3. The method as in claim 1 or 2, characterized in that control of the amplitudes takes place digitally.

4. The method as in claim 3, characterized in that output of a new control value for the excitation amplitude takes place precisely n times per mass, n being a whole number.

5. The method as in claim 3, characterized in that the output time intervals for control values and the fundamental oscillations for the storage and excitation frequencies to be applied are derived from a single master oscillator.

6. The device for recording the mass spectra of stored ions, consisting of an RF quadrupole ion trap with one ring electrode and two end cap electrodes, a storage RF generator for producing the quadrupole storage field, an excitation RF generator for a voltage straight across the two end cap electrodes, a control element for the amplitude of the storage alternating voltage for producing the mass scan, a control element for the amplitude of the excitation alternating voltage, and an ion measuring device for producing the mass spectrum output signal, characterized in that the control element for the excitation amplitude outputs a control voltage which is proportional to the root of the storage field amplitude.

7. The device as in claim 6, characterized in that the control elements operate digitally.

8. The device as in claim 7, characterized in that the two control elements take the form of programmed control processes in a joint microprocessor.

* * * * *